US005127620A

United States Patent [19]

Bleim et al.

[11] Patent Number: 5,127,620

[45] Date of Patent: Jul. 7, 1992

[54] SEPARATOR ASSEMBLY

[75] Inventors: Roger A. Bleim, 2957 N. Island Cir., Port Clinton, Ohio 43542; Charles C. Swearingen, Fremont, Ohio

[73] Assignee: Roger A. Bleim, Port Clinton, Ohio

[21] Appl. No.: 444,392

[22] Filed: Dec. 1, 1989

Related U.S. Application Data

[63] Continuation-in-part of Ser. No. 367,351, Jun. 16, 1989, Pat. No. 5,127,619.

[51] Int. Cl.[5] ..... B65D 19/00

[52] U.S. Cl. ..... 248/346

[58] Field of Search ..... 248/346; 108/51.1, 55.3, 108/55.5; 428/218, 68, 36.91

[56] References Cited

U.S. PATENT DOCUMENTS

| | | | |
|---|---|---|---|
| 2,916,159 | 12/1959 | O'Neil | 248/909 X |
| 3,567,068 | 3/1971 | Carfizzl | 248/346 X |
| 3,814,778 | 6/1974 | Hosoda et al. | 108/51.1 X |
| 3,832,955 | 9/1974 | Pottinger et al. | 108/151.1 |
| 3,911,182 | 10/1975 | Lieberman | 108/51.1 X |
| 4,116,344 | 9/1978 | Ziemba | 248/346 X |
| 4,386,704 | 6/1983 | Maillet | 108/51.1 |
| 4,579,320 | 4/1986 | Gladish | 248/346 X |
| 4,714,026 | 12/1987 | Yamaguchi et al. | 108/51.1 |
| 4,789,046 | 12/1988 | McDowall | 248/346 |
| 4,838,169 | 6/1989 | Gladish | 108/51.1 X |

FOREIGN PATENT DOCUMENTS

| | | | |
|---|---|---|---|
| 7014139 | 1/1972 | France | 108/55.3 |

*Primary Examiner*—Alvin C. Chin-Shue

*Attorney, Agent, or Firm*—Emch, Schaffer, Schaub & Porcello Co.

[57] ABSTRACT

A coil separator for spacing stacked coils is disclosed. The separator includes an elongated body member having a rigid inner core and an outer skin having a density less than the density of the core.

10 Claims, 1 Drawing Sheet

SEPARATOR ASSEMBLY

The present invention is an improvement and a continuation-in-part to copending U.S. patent application Ser. No. 367,351, filed Jun. 16, 1989 U.S. Pat. No. 5,127,619, issued Jul. 7, 1992.

BACKGROUND OF THE INVENTION

The present invention relates to separating spaced articles and more specifically coil separators for spacing stacked metal coils.

Steel and other metals are often stored in coils. During shipment and storage, the coils are generally arranged in stacks and separated by radially disposed separators.

Many kinds of separators have been used in the prior art. Prior art wood and compressed paper separators tend to absorb water. If the metal coils are prone to oxidation, the moisture in the separator can result in edge damage to the metal. Unevenly sawed wood separators have also been a problem.

Furthermore, if the materials used in the separators compress, this can result in undesired shifting of the coils. However, it has been found that if the separators are extremely rigid, the softer metal coils can also be edge damaged merely by the rigid separators.

SUMMARY OF THE INVENTION

The present invention is directed to a separator for spacing stacked articles and, more particularly, in a separator assembly for spacing stacked metal coils.

The separator includes an elongated body member preferably constructed of plastic. The body member has an inner rigid core and an outer skin having a density less than the density of the inner core.

DESCRIPTION OF THE PREFERRED EMBODIMENTS

Figure 1:
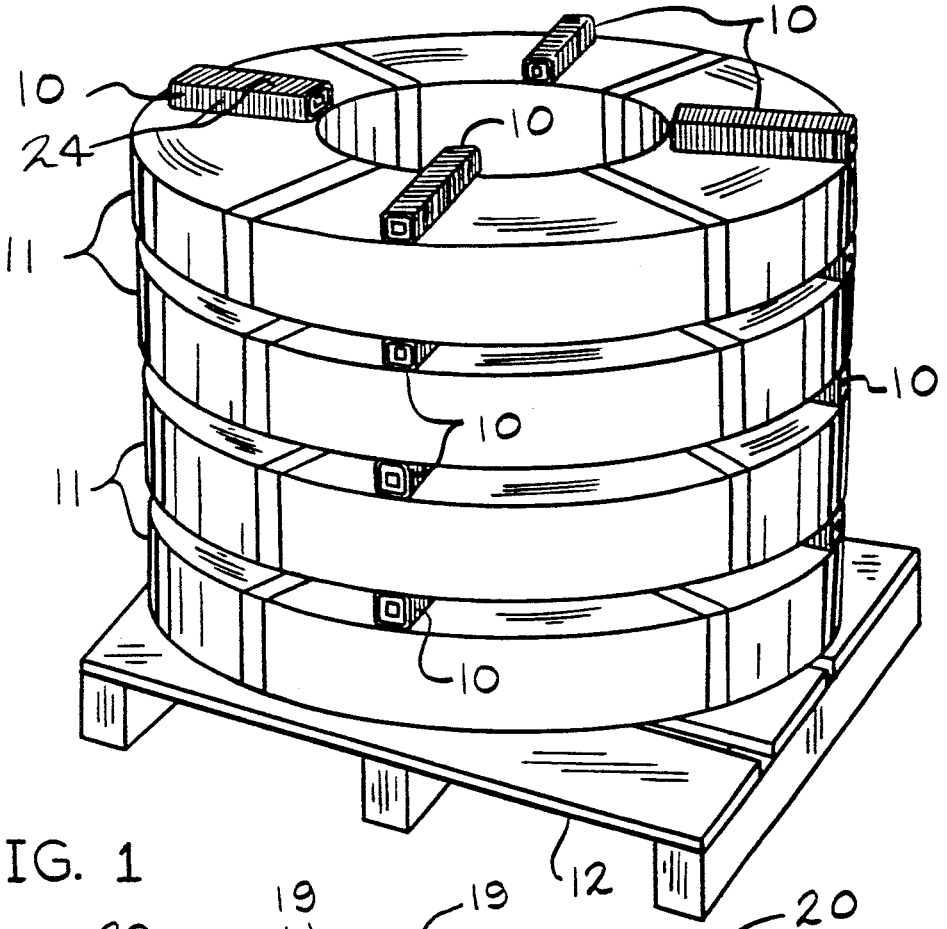
FIG. 1 is a perspective view showing a plurality of vertically stacked metal coils disposed on a pallet and separated by separator assemblies, according to the present invention.
Figure 2:
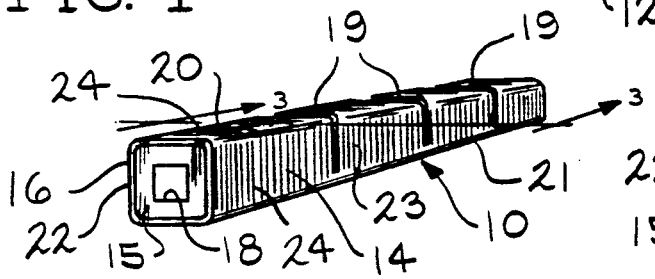
FIG. 2 is perspective view of one embodiment of a generally rectangular separator assembly, according to the present invention.
Figure 3:
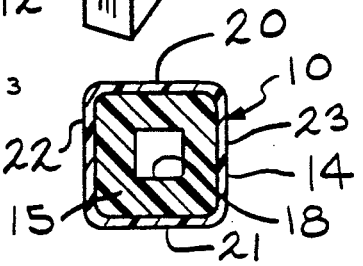
FIG. 3 is a cross sectional view taken along the line 3—3 of FIG. 2.

Referring to FIGS. 2 and 3, a separator assembly, according to the present invention, is generally indicated by the reference number 10. Referring to FIG. 1, a plurality of separator assemblies 10 are shown in use to space vertically stacked metal coils 11, which are resting on a pallet 12.

The stacked assembly 10 may be constructed of various materials, however, it is found that plastic materials are preferable. The separator assembly 10 is preferably constructed by extruding and it has been found that thermoplastic materials such as polyvinyl chloride, acrylonitrile butadiene styrene, polystyrene or the like may be used. The separator assembly 10 includes an elongated body member 14 having an inner rigid core 15 and an outer skin 16. A longitudinally extending passageway 18 extends completely through the core 15.

In the present embodiment, a plurality of transverse kerfs 19 extend from an upper surface 20 of the body member 14 downwardly to a point adjacent the lower surface 21 of the body member 14. Sidewalls 22 and 23 connect the upper surface 20 and the lower surface 21. While the upper surface 20 and the lower surface 21 are generally flat, other embodiments may be designed which have various configurations so long as the upper surfaces 20 and lower surfaces 21 provide bearings to correctly space the individual metal coils 11 in a vertically stacked manner, as shown in FIG. 1.

Preferably the surfaces 20 and 21 together with the sidewalls 22 and 23 are knurled to form a plurality of transverse grooves 24 which are generally parallel to the kerfs 19. The grooves 24 tend to reduce slippage when the separator assemblies 10 are placed between and on the metal coils 11, as shown in FIG. 1.

In the embodiment shown in FIGS. 2 and 3, the separator assembly 10 is constructed by a coextrusion process using polyvinyl chloride. The core 15 is constructed of a density which is greater than the density of the outer skin 16. It has been found that the rigid core 15 supplies the necessary structural strength while the more skin 16 is relatively flexible and does not damage the edges of the metal coils 11. Preferably the core 15 has a D Scale Durometer hardness of between 65 and 85. The more flexible outer skin 16 preferably has an A Scale Durometer hardness of between 65 and 85.

In the present embodiment, the rectangular body member 14 is square and is constructed of various sizes between 0.8125 inch and 1.5 inch. In the embodiment show in FIG. 2, the thickness of the skin, which has been coextruded, is 0.040 inch. It is understood that other sizes of the assembly may be constructed.

Figure 4:
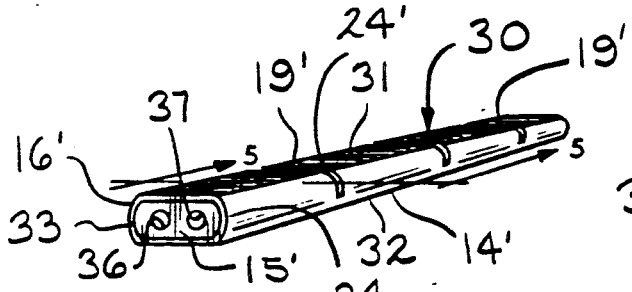
FIG. 4 is another embodiment of a coil separator, according to the present invention, which has a generally oval cross section.
Figure 5:
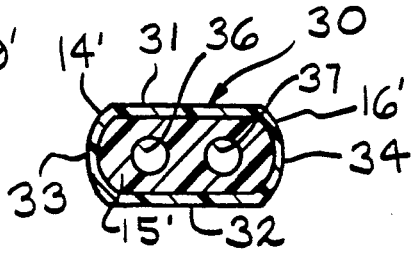
FIG. 5 is an enlarged cross sectional view taken along the line 5—5 of FIG. 4.

Another embodiment of a separator assembly, according to the present invention, is indicated in FIGS. 4 and 5 by the reference number 30. The separator assembly 30 has a generally oval cross section. The assembly 30 has a generally flat upper surface 31 and a generally flat lower surface 32. The upper surface 31 and lower surface 32 of the separator assembly 30 are joined together by opposed sidewalls 33 and 34 which are curvilinear.

The separator assembly 30 includes a longitudinally extending body member 14' consisting of a relatively rigid core 15' and a coextruded more flexible skin 16'. Again, the core 15' has a D Scale Durometer hardness of between 65 and 85 and the coextruded skin 16' has an A Scale Duromer hardness of between 65 and 85.

A plurality of transverse kerfs 19' are cut through the body member 14' from the upper surface 31 to a point adjacent the lower surface 32. The kerfs 19' allow a user to break the overall spacer assembly 30 into smaller parts for use in various applications.

The upper surfaces 31 and 32 are knurled to form a plurality of transverse grooves 24', which are generally parallel to the kerfs 19'.

The separator assembly 30 also includes a pair of longitudinally extending circular passageways 36 and 37 which extend completely through the body member 14'.

While the separator assembly 30 may be constructed of various dimensions, the separator assembly 30 illustrated in FIGS. 4 and 5 has a width of approximately 1.0 inch and a depth of 0.5 inch. The skin 16' having a thickness of 0.040 inch.

It has been found that separator assemblies, according to the present invention, including the separator assemblies 10 and the separator assemblies 30 provide flexibility when used as spacers of coiled metals. The assemblies 10 and 30 provide sufficient rigidity while at the same time their more flexible outer skins do not damage metal coils, for example, nonferrous coils.

It is noted that many modifications and revisions may be made to the specific preferred embodiments disclosed herein without departing from the scope of the following claims.

We claim:

1. A coil separator for stacking metal coils comprising, in combination, an elongated body member having an upper surface and an opposed lower surface, said body member being constructed of a plastic material, sidewalls connecting said upper and lower surfaces, said body member having an inner rigid plastic core of a predetermined density and an outer plastic skin of a density less than such predetermined density, said core and said skin being bonded by coextrusion, said core having a D Scale Durometer hardness between 65 and 85 and said outer skin having an A Scale Durometer hardness of between 65 and 85, whereby said core supplies structural strength to such separator and said skin supplies a relatively flexible surface upon which such metal coil can rest without damage to the edges of such metal coil.

2. A separator, according to claim 1, wherein said separator includes a longitudinal passageway extending through said core.

3. A separator, according to claim 1, including a plurality of transverse kerfs spaced along said longitudinal body member.

4. A separator, according to claim 1, including a plurality of transverse grooves defined in said upper and lower surfaces.

5. A separator, according to claim 1, wherein said body member has a generally rectangular cross section.

6. A separator, according to claim 1, wherein said body member has a generally oval cross section.

7. A separator, according to claim 1, wherein said plastic material is polyvinyl chloride.

8. A coil separator for spacing stacked metal coils comprising, in combination, an elongated body member constructed of plastic, said plastic comprising polyvinyl chloride, said body member having an inner rigid plastic core and an outer relatively flexible plastic skin having a density less than the density of said inner core, said core and said skin being bonded by coextrusion, whereby said core supplies structural strength to such separator and said skin supplies a relatively flexible surface upon which such metal coil can rest without damage to the edges of such metal coil.

9. A separator, according to claim 8, wherein said separator includes a plurality of transverse kerfs spaced along said elongated body member.

10. A separator, according to claim 8, wherein said outer skin defines a plurality of transverse grooves.

* * * * *